US009576444B2

(12) United States Patent
Huang et al.

(10) Patent No.: US 9,576,444 B2
(45) Date of Patent: Feb. 21, 2017

(54) SOLAR LIGHT-EMITTING DIODE LAMP WIRELESS SENSOR DEVICE FOR MONITORING STRUCTURE SAFETY IN REAL-TIME

(71) Applicant: INTERNATIONAL MOBILE IOT CORP., Taipei (TW)

(72) Inventors: Jung-Tang Huang, Taipei (TW); Chun-I Sun, New Taipei (TW)

(73) Assignee: INTERNATIONAL MOBILE IOT CORP., Taipei (TW)

( * ) Notice: Subject to any disclaimer, the term of this patent is extended or adjusted under 35 U.S.C. 154(b) by 276 days.

(21) Appl. No.: 14/300,241

(22) Filed: Jun. 10, 2014

(65) Prior Publication Data

US 2014/0361888 A1 Dec. 11, 2014

(30) Foreign Application Priority Data

Jun. 10, 2013 (TW) ..... 102210815 U

(51) Int. Cl.
*G08B 5/36* (2006.01)
*G08B 25/00* (2006.01)

(52) U.S. Cl.
CPC ..... *G08B 5/36* (2013.01); *G08B 25/009* (2013.01)

(58) Field of Classification Search
CPC ..... G08B 25/009; G08B 5/36; G08B 21/182; G08B 25/007; G08B 7/066; G08B 13/19; H04L 67/12; H04L 41/082; H04L 41/0869
See application file for complete search history.

(56) References Cited

U.S. PATENT DOCUMENTS

2006/0155818 A1* 7/2006 Odenwald ..... H04L 41/082 709/208
2007/0257625 A1* 11/2007 Brison ..... G08C 17/00 315/291
2014/0167969 A1* 6/2014 Wedig ..... G08B 7/066 340/584

* cited by examiner

*Primary Examiner* — An T Nguyen
(74) *Attorney, Agent, or Firm* — Jianq Chyun IP Office

(57) ABSTRACT

A long time monitoring and self-powered solar light-emitting diode (LED) lamp wireless sensor device, capable of monitoring bridge, building or structure in real-time. The device comprises a substrate, at least one LED lamp bead, a rechargeable battery, a solar cell, at least one wireless communication module, at least one sensor and a control unit. The device is contained in a casing having a transparent region and a waterproof function. The solar cell stores energy into the rechargeable battery in sunshine environment, and by comparing the sensing value with a threshold, it is determined whether a safety issue occurs, so as to emit alert. In the night, the rechargeable battery supplies power to the LED lamp beads for illumination or decoration lighting of the structure. Wireless communication links the entire system for providing safety monitoring information, LED lighting or decoration instruction.

10 Claims, 7 Drawing Sheets

SOLAR LIGHT-EMITTING DIODE LAMP WIRELESS SENSOR DEVICE FOR MONITORING STRUCTURE SAFETY IN REAL-TIME

CROSS-REFERENCE TO RELATED APPLICATION

This application claims the priority benefit of Taiwan application serial no. 102210815, filed on Jun. 10, 2013. The entirety of the above-mentioned patent application is hereby incorporated by reference herein and made a part of this specification.

BACKGROUND

Technical Field

The invention relates to an apparatus and system combined with a structural safety monitoring function and a lighting function.

Related Art

A bridge across a valley or serving as a viaduct is constantly influenced by stableness of a foundation, and after the bridge suffers from wind, sunshine, rain and other weather changes for a long period of time, and is even wrecked by earthquakes, typhoons, lightning and other harsh weather conditions plus frequent overload of vehicles driving thereon and a fatigue stress load of long time vibration, either the bridge is naturally aged due to disrepair or sometimes the bridge encounters an accident of sudden tilt or fracture. Especially, bridges, buildings and other structures located in an area with frequent economic activities are in need of long-term monitoring. Conditions of roads and bridges in remote area are hard to be monitored and managed by manpower. Therefore, it is necessary and important to seek an economic and efficient solution.

In view of bridge structural health monitoring (SHM), a conventional method is to develop a bridge safety monitoring system by using hydraulic pressure gauges, inclinometers and tension meters, and the various sensors are connected to a data server through optical fiber wiring for data interpretation, and related data is transmitted to a cloud end through a telecommunication network, by which a pier tunneling condition, a bridge tilt condition and a bridge gap condition are automatically monitored to ensure safety of the bridge. A main disadvantage thereof lies in an expensive setup cost, and serial connection between the sensing nodes requires optical fiber or electric wire, and if a certain node is damaged, direct replacement thereof is not easy. Moreover, a city power or a large battery is required to supply power thereto. Therefore, since the deployment of the sensing nodes is not easy, and multi-point deployment cannot be implemented, there are many blind spots and omissions on a monitoring network. In some foreign countries, although a wireless sensor network (WSN) especially a Zigbee is used to monitor the bridge, a function thereof is limited to transmission of sensing data of the sensor of each node, and a whole operation mechanism or an added value is not provided. Moreover, the sensing data can only be transmitted through the WSN, and if any node or a main node of the WSN is damaged, or functions of the system are incomplete, or the whole system is malfunction, in case of absence of auto repair or absence of an emergency replacement mechanism, difficulties in manual maintenance and reconfiguration are additional encountered. Moreover, the aforementioned apparatus and system cannot monitor and warn the overload vehicles in real-time.

SUMMARY

The invention provides a safety monitoring apparatus and a system thereof for bridge, building or structure, and a theory thereof is based on an energy method—the theorem of Castiano, by which when a structure is subjected to various loads (for example, vehicles, pedestrian, machinery, self weight, strong winds, heavy rain, river flow impact, terrain latent change or earthquake, etc.), and the structure is still in an elastic safety range, i.e. a stress of the material of the structure does not exceed a yield-point thereof, and a whole displacement is a linear function of a whole load, and an overlapping principle is applicable. Therefore, regardless of whether a single device is used to test one point or multiple devices are used to test different positions, and regardless of whether it is the maximum amplitude position or resonant node, the above theoretical basis can all be used to regard current data as safety amplitude, vibration frequency, etc. When any point on the structure is damaged, especially when a pier cornerstone is scoured and an exposed length thereof is changed, the pier cornerstone is eroded under water flow, and the structure is locally fractured in internal thereof, etc., there are different degrees of changes in a cross-sectional area, an elastic coefficient, a shear elastic coefficient, a shaft moment of inertia, a polar moment of inertia, a volume elastic coefficient, or even a length, etc. on a stress bearing point, which may accordingly change an amplitude, a vibration frequency, etc. of the structure, or present a high frequency vibration, sudden change, etc. in real-time. Under a long-term tracking and recording practise, safety peak data of different structures and different measuring points are obtained to accordingly define a time-scale threshold and an instantaneous strength threshold for safety monitoring. When the monitored data exceeds the threshold, the apparatus or system may send a warning message, and usage of the structure can be prohibited to prevent accidents, or the structure can be strengthened to prolong a service life thereof, or the structure can be locally strengthened to decrease a maintenance cost of the structure.

An embodiment of the invention provides a safety monitoring apparatus for bridge, building or structure, and each monitoring apparatus is installed with a three-axis accelerometer, by which not only a long-term variation of an inclination of a foundation at the installation place is monitored, a transient monitoring is also implemented, and a sensing value of the three-axis accelerometer is regularly read for determination. The determination is performed according to an inbuilt formula and historical data to determine whether there is a safety issue, where the inbuilt formula or a look-up table can be obtained by simulating the whole bridge to evaluate a safety data range of each node that is influenced by wind, earthquake or large vehicles, etc.

An embodiment of the invention provides a safety monitoring apparatus for bridge, building or structure, and each monitoring apparatus uses a solar battery as a power supply, and a consecutive wireless communication mechanism is used to transmit monitoring data, so as to facilitate installing outdoors for a long-term usage. Since electricity arrangement and wire arrangement are not required, in collaboration with a data processing capability of the apparatus, in case of a natural disaster, even if power and communication are cut off, the real-time and continuous security monitoring mechanism still functions. Since it is unnecessary to replace a battery, maintenance cost and related expenses are accordingly decreased. Since electricity arrangement and wire arrangement are not required, when a location of a monitoring spot is improper, the location can be easily changed for amelioration, and only a mechanical fixing part is required to be disassembled, and after reallocation is completed, the apparatus is reset to continue monitoring. Similarly, equipment replacement due to malfunction is also easy.

An embodiment of the invention provides a safety monitoring apparatus for bridge, building or structure, where each safety monitoring apparatus includes a light-emitting diode (LED) lighting mechanism and has a decoration effect. The apparatus self determines and sets a control instruction for lighting LED lamp beads according to a lighting intensity and a charging power of the apparatus, or obtains the control instruction of the LED lamp beads from external through a wireless communication module, and presents a lighting effect of different frequencies, colors and brightness according to the control instruction. Under a coding operation of the whole system, complicated decoration lighting patterns varied along with time can be presented, and a combination of a huge amount of the lighting patterns can serve as a billboard. In this case, an added value of the apparatus is increased, and when the apparatus is damaged, as the added value of the apparatus is accordingly disappeared, a repair and maintenance mechanism is forced to quickly react, by which integrity of the safety monitoring function is compensated and assisted, so as to avoid natural waste of the apparatus.

An embodiment of the invention provides a safety monitoring apparatus and a system thereof for bridge, building or structure, where each safety monitoring apparatus has a wireless communication function, and the apparatus can automatically switch a master-slave identity, and transmit data in a consecutive manner having a range exceeding a transmitting and receiving range of a single radio device, and can also directly communicate with a mobile communication device (a mobile phone or a tablet PC, etc.) in case that a radio communication gateway/router is damaged, and any ambient available mobile communication device serves as the gateway/router, and based on an automatic repair function, data is still transmitted to a main control center through Internet. When the communication is interrupted, the apparatus is capable of self processing data of detection sensor. Therefore, although the network is disconnected, and there is no available temporary gateway/router, the monitoring apparatuses can still communicate with each other, and when any single monitoring apparatus has a safety issue, a warning message is sent onsite, or neighbouring monitoring apparatuses are notified to commonly send the warning message, so as to achieve a maximum warning effect. Alternatively, the main control center is notified to decrease occurrence of structure accident, or the single apparatus send the warning message by itself to achieve a basic warning effect.

An embodiment of the invention provides a safety monitoring apparatus and a system thereof for bridge, building or structure, where each monitoring apparatus has a safety monitoring sensor and has a wireless communication function, and the apparatus can automatically switch a master-slave identity, and transmit data in a consecutive manner having a range exceeding a transmitting and receiving range of a single radio device, by regularly adjusting a timer of each monitoring apparatus, the monitoring apparatuses are synchronous, and then each of the monitoring apparatuses continuously records sensing values of the safety monitoring sensors thereof at a fixed sampling time, and transmits the sensing data to the main control center in batches for long-term recording or study and determination. A method of study and determination is to compare a normal value obtained through computer simulation according to dynamic behaviours of the monitored structure with a measuring value of each monitoring apparatus to determine whether the measuring value is abnormal.

An embodiment of the invention provides a safety monitoring on-site warning apparatus and a system thereof for bridge, building or structure. When a vehicle passing through the structure is overload, for example, a gravel truck, a heavy-duty vehicle, etc., based on monitoring of each location, as the vehicle produces a strong vibration that exceeds a safety threshold when passing through the structure, each of the monitoring apparatuses along the road displays an overload message through built-in LED lamps, so as to implement immediate interception to prevent continuous expansion of the destruction, or achieve a deterrent effect. In a storm, along with wind and rain of that moment and rising of water flow, it is determined whether a dangerous situation is entered in real-time, and the dangerous situation is indicated by a LED lamp message of the apparatus in real-time.

In summary, the invention provides a multi-function wireless safety monitoring apparatus and a system for bridge or building, which additionally have functions of illumination, decoration, display, warning, etc. to mitigate disadvantages of a conventional monitoring system, so as to create a globally applicable safety monitoring mechanism for bridge, building or structure, which not only has features of easy installation and easy setting, but also has a real-time monitoring function and a warning function, and is capable of safely operating when communication and power supply are cut off due to a natural disaster. Moreover, basic elements are creatively used to enhance an added value of the system, such that the safety monitoring system is more valuable, so as to avoid a situation of just finding that the monitoring apparatus set up according to the conventional technique has failed for a long time due to damage after occurrence of an accident, and losing the function of sending the warning message in time or in advance due to that the maintenance is not easy, or the communication and power supply are cut off in the surrounding area.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

Hardware components of a structural safety monitoring and luminary lighting apparatus and a system thereof of the invention include a solar LED lamp wireless sensor device, a solar LED lamp wireless sensor device and a router of an inbuilt router, or in collaboration of a general router in the market, the apparatus and system can be connected to a server of the Internet and a main control center to form an integral monitoring and lighting system.

Basic Structure of the Solar LED Lamp Wireless Sensor Device

Figure 1:
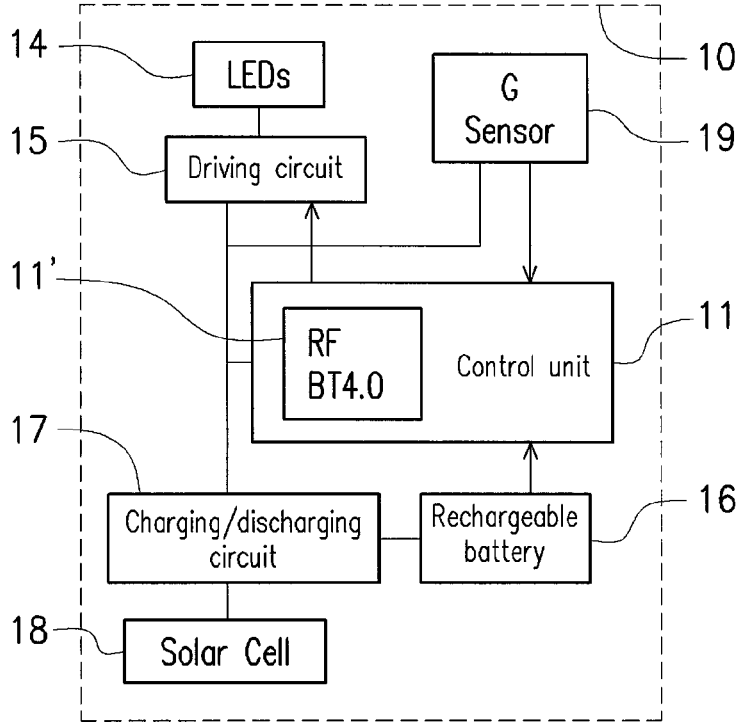
FIG. 1 and FIG. 2 are circuit structural diagrams of a solar LED lamp wireless sensor device.
Figure 2:
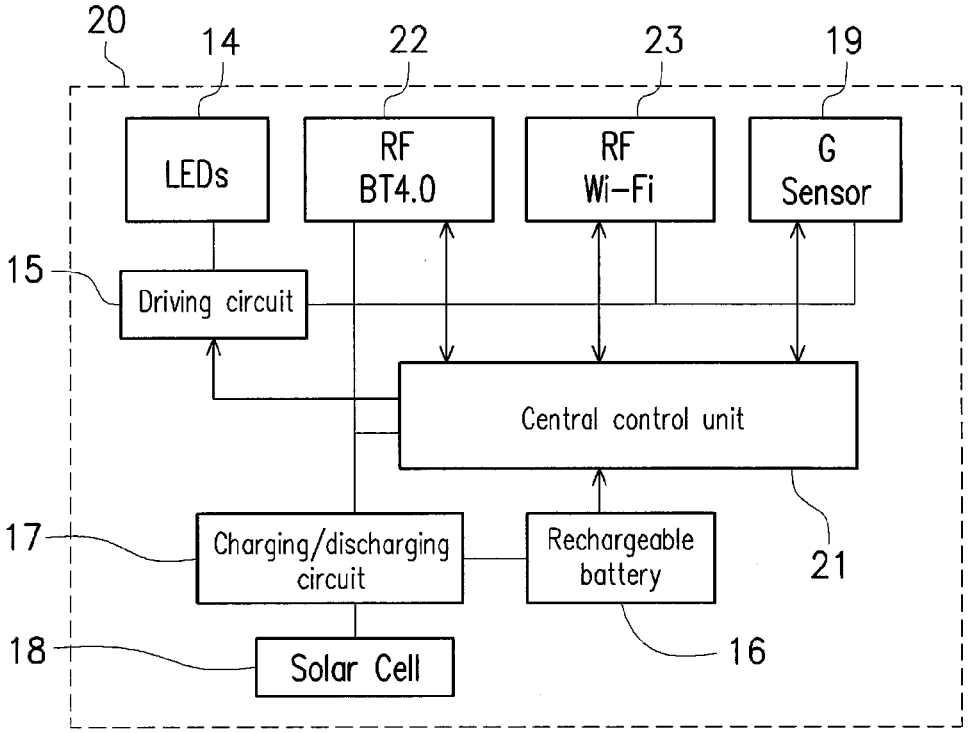
Figure 3:
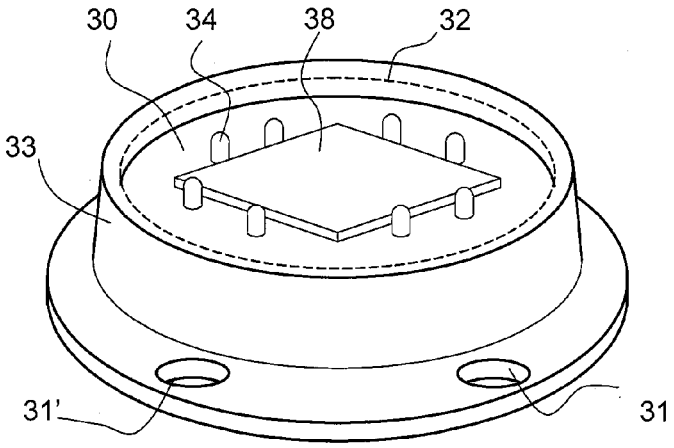
FIG. 3 is a profile diagram of a solar LED lamp wireless sensor device.

Referring to FIG. 1, FIG. 2 and FIG. 3 for the basic structure of the solar LED lamp wireless sensor device. FIG. 1 and FIG. 2 are circuit structural diagrams of the solar LED lamp wireless sensor device, and FIG. 3 is a profile diagram of the solar LED lamp wireless sensor device.

Referring to FIG. 1, the embodiment of FIG. 1 provides a basic circuit structure of the apparatus of the invention, and a circuit substrate 10 thereof includes LED lamp beads 14, a driving circuit 15, a sensor 19 of at least one monitoring mechanism, a wireless communication module 11' used for transmitting data and exchanging operation instructions to external, and a solar cell 18 used for providing an overall operation power to the substrate, which is electrically connected to a rechargeable battery 16 through a charging/discharging circuit 17. When the apparatus is irradiated by light, the solar cell 18 generates electric energy and provides the electric energy to the apparatus and charges the rechargeable battery 16. When the light is insufficient, the rechargeable battery 16 discharges to supply power to the apparatus for operation. A control unit 11 is in charge of a whole operation of the apparatus, and the control unit 11 is electrically connected to the LED lamp beads 14, the driving circuit 15, the sensor 19, the wireless communication module 11' and the rechargeable battery 16 to control the whole operation of the apparatus. The wireless communication module 11' can be complied with standards of Bluetooth version 4.0 (Bluetooth low energy) or version above, and the control unit 11 and the wireless communication module 11' can be integrated and merged into a single operation device to form a simplest basic element.

Referring to the circuit structure of FIG. 2, the circuit structure of FIG. 2 is adopted in order to save configuration and adoption of the other network devices of the "structural safety monitoring lighting apparatus and system thereof", so as to reduce the inconvenience of electricity arrangement and wire arrangement of the apparatus onsite. In the circuit structure of FIG. 2, a Wi-Fi wireless communication module 23 and a bluetooth wireless communication module 22 capable of direction connecting the Internet from a remote end are used to replace the wireless communication module 11' of FIG. 1. A central control unit 21 can be integrated with the bluetooth wireless communication module 22 or the Wi-Fi wireless communication module 23 to form a single device, or the above components can be separately disposed and are electrically connected through a control circuit. The circuit structure of FIG. 2 further includes the LED lamp beads 14, the driving circuit 15, the sensor 19, the solar cell 18, the charging/discharging circuit 17 and the rechargeable battery 16, which are electrically connected to the circuit substrate 20.

The safety sensor 19 of FIG. 1 and FIG. 2 is a multi-axis motion sensor selected from a three-axis accelerometer, a gyroscope, an electronic compass and a altimeter, etc., and in an exemplary embodiment, only the three-axis accelerometer is used to sense acceleration variation values of different axial directions along with vibration of the whole apparatus. When two three-axis accelerometers are disposed at diagonal positions of the apparatus or a six-axis acceleration sensor is direction configured, the sensor can directly measure a variation amount and a variation period of a vibration displacement acceleration of each axial direction and a rotation angle acceleration, etc.

Regarding the concept of three axial directions, regardless an angle change of the apparatus, the apparatus can simultaneously measure up and down or back and forth vibration values and resonant values of the bridge impacted by a horizontally flowed water flow and influenced by driving variations of vehicles passing there through. Therefore, based on the concept of the three axial directions, the apparatus is not influenced by a usage environment, an installation orientation, an angle status, etc., so as to avoid causing inconvenience in installation and application.

When the safety sensor 19 is a three-axis accelerometer and includes a temperature sensor, besides data of accelerations of each axial direction is measured, influence on variations of the structure due to temperature difference between day and night, and a temperature difference between four seasons is also measured.

When the safety sensor 19 is a three-axis accelerometer and includes an exposed humidity sensor, besides data of accelerations of each axial direction is measured, humidity of different parts of the structure or distribution of rain covering part of the structure can also be measured, so as to define different time-dimension thresholds to structure materials, or monitoring control values limited by a local maintenance period.

When the safety sensor 19 is a three-axis accelerometer and includes an exposed wind speed sensor, besides data of accelerations of each axial direction is measured, a relationship between the strong wind and a vibration response of the structure can also be measured.

When the safety sensor 19 is a three-axis accelerometer and includes an exposed water (liquid) level ultrasonic sensor, besides data of accelerations of each axial direction is measured, the safety sensor 19 can directly measure whether a water (liquid) level under the bridge exceeds a security alert level.

When the safety sensor 19 is a three-axis accelerometer and includes a tilt sensor, besides data of accelerations of each axial direction is measured, the safety sensor 19 can also be applied for monitoring railroad, electric tower, etc. deployed in wild to prevent subsidence, tilt and sliding of a foundation and tracks of the railroad.

Referring to FIG. 3, the whole circuit structure is contained in a mechanical casing 33 with a waterproof mechanical structure, and a waterproof transparent part 32 is disposed at a corresponding region, such that the light can irradiate a solar cell 38 disposed on a substrate 30, and light emitted from LED lamp beads 34 can emit out. The mechanical casing 33 can be fixed to the structure through a general mechanical method, for example, through mechanical fixing holes 31 and 31', screws can be used to directly fix the mechanical casing 33 to the structure.

Embodiments of Communication Steps

Figure 4:
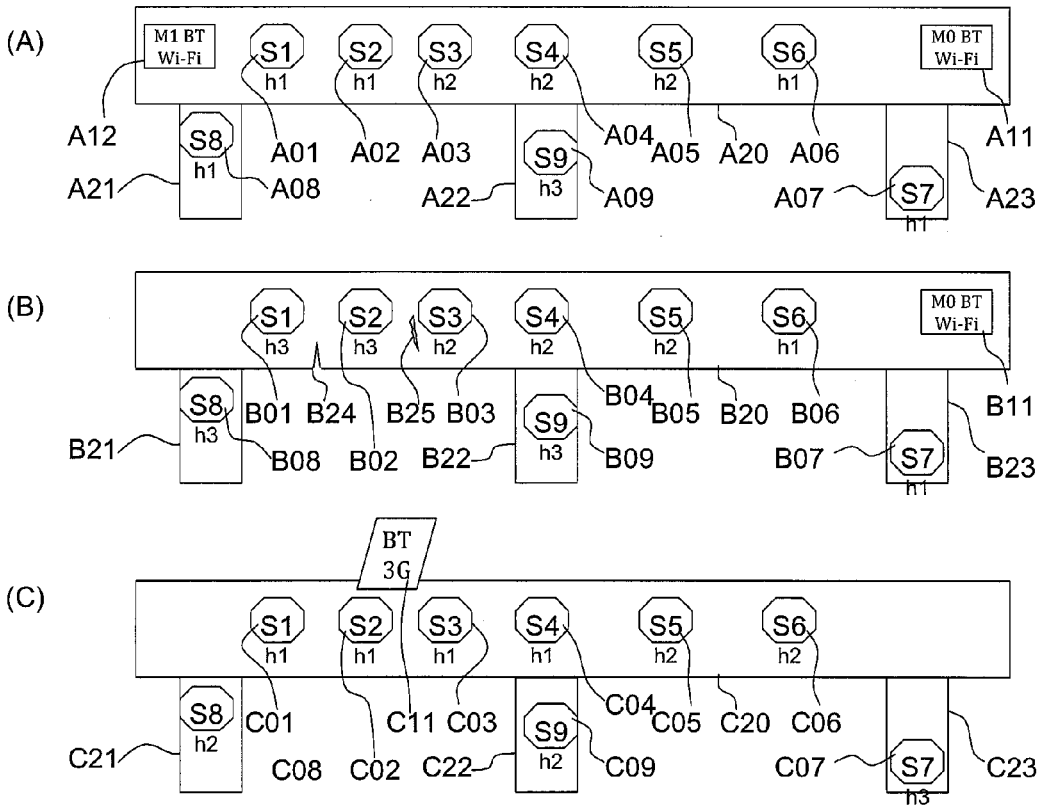
FIG. 4 is a schematic diagram of communication implementation of a structural safety monitoring and lighting system.

FIG. 4(A), 4(B) and 4(C) are schematic diagrams of communication continuations of the structural safety monitoring and lighting apparatus and system thereof of the invention. Application of a bridge is taken as an example for descriptions, and regarding applications of other structures, communication continuation thereof are the same.

As shown in FIG. 4(A), a plurality of solar LED lamp wireless sensor devices A01-A09 are installed on a bridge A20 and bridge posts A21, A22 and A23. Wireless communication relay stations A11 and A12 are disposed at two ends of the bridge A20, where the relay stations A11 and A12 can be Bluetooth access points, or Bluetooth access point in collaboration with gateway of Wi-Fi, or the solar LED lamp wireless sensor devices are inbuilt with routers, etc. In case that the relay stations A11 and A12 are connected to a server of a main control center at a remote end through the Internet, an operation system is formed. When the solar LED lamp wireless sensor devices A01-A09 are installed to the structure one-by-one and start to operate, the relay stations A11 and A12 serve as master nodes, and the solar LED lamp wireless sensor devices A01, A02, A08, A06 and A07 within direct radio communication ranges of the relay stations A11 and A12 are first discovered, and are set as slave nodes, and are written with server authentication codes to complete confirming an authentication procedure of the server of the main control center. Each of the above devices is recorded to require one radio hop (h1) for connecting the relay station. The authentication procedure can be completed by using a mobile phone or a tablet PC through a direct writing manner. Then, the solar LED lamp wireless sensor devices A01, A02, A08, A06 and A07 that only require one radio hop (h1) for connecting the relay station serve as the master nodes to search other solar LED lamp wireless sensor devices without completing the setup procedure. Therefore, the solar LED lamp wireless sensor devices A03, A04 and A05 are discovered, and accordingly complete the setup procedure required during an installation setting process. Different to the aforementioned devices, the secondary discovered devices are recorded to require two radio hops (h2) for connecting the relay station. By repeating the above procedure, when a new device is installed, as long as there is a solar LED lamp wireless sensor device without completing the setup procedure, it is discovered and completes the required setting and connecting procedure. When any one of the solar LED lamp wireless sensor devices is to transmit data to the server of the main control center, the neighbouring solar LED lamp wireless sensor device with less hops transfers the data. Namely, the device of h3 can transmit data through any of the devices of h2, and the device of h2 can transmit data through any of the devices h1. A returned transmission result and other instructions can be transmitted through a reverse path.

As shown in FIG. 4(B), a plurality of solar LED lamp wireless sensor devices B01-B09 are installed on a bridge B20 and bridge posts B21, B22 and B23. A wireless communication relay station B11 is disposed at a right end of the bridge B20. When the bridge has an internal damage B25 or an external damage B24 to obviously change a vibration frequency and amplitude, or when the solar LED lamp wireless sensor devices B01, B02 and B08 are about to transmit data to the server of the main control center, compared to the embodiment of FIG. 4(A), if the solar LED lamp wireless sensor devices B01, B02 and B08 are originally set to require only one radio hop (h1) for connecting the relay station, as the relay station located at the left end of the bridge is either damaged or removed, solar LED lamp wireless sensor devices B01, B02 and B08 cannot be connected to the relay station. Each of the devices that cannot transmit data starts to gradually increase the referential number of the radio hops to search other applicable devices, i.e. tries to connect the devices of h1, and degrades to the devices of h2 and h3 if the connection cannot be established, so as to automatically search the other nodes capable of connecting the relay station. Therefore, the solar LED lamp wireless sensor devices B01, B02 and B08 are reset to devices that require three radio hops (h3) for connecting the relay station. In this way, the system is replied to have a normal connection status, and the safety monitoring mechanism is notified.

As shown in FIG. 4(C), a plurality of solar LED lamp wireless sensor devices C01-C09 are installed on a bridge C20 and bridge posts C21, C22 and C23. The wireless communication relay stations disposed at two ends of the bridge C20 cannot be connected due to damage. Now, a neighbouring mobile device, for example, a mobile phone or a tablet PC C11 capable of connecting the Internet can be used to replace a task of the relay station, and execute a functional application program of a router to replace the function of the original relay station. In this way, the communication connection is maintained to ensure integrity of the monitoring function.

In an exemplary embodiment, the damage level of the bridge (i.e. structure) can be seen as the reduction of the natural (main) frequency of the structure, namely, the reduction of the stiffness. Based on $\omega=(k/m)^{1/2}$, where $\omega$ represents the natural frequency, k represents the stiffness, and m represents the mass. The variation of the mass is limited when the structure is fractured or the bridge pier is scoured and exposed, but the equivalent stiffness has a larger variation, and therefore, the reduction of the natural frequency is the reduction of the stiffness. If it wants to obtain the mode shape, the accelerometers respectively disposed on a plane between two adjacent bridge piers and installed in the solar LED lamp wireless sensor devices should simultaneously record and transmit the same to the central control unit for computing. In some exemplary embodiments, only a part of the solar LED lamp wireless sensor devices applied in the bridge monitoring may either be the three-axis accelerometers having high sensitivity and low noise or be the single-axis accelerometers (i.e. measuring the environment vibration of the portion(s) perpendicular to the bridge deck), and the other of the solar LED lamp wireless sensor devices applied in the bridge monitoring may be configured to serve as hops. For example, the corresponding references (i.e. natural frequency, damping ratio, etc.) can be assigned to each of the solar LED lamp wireless sensor devices for comparison, and then the parameters of the structure characteristics for each solar LED lamp wireless sensor device can be continuously sampled for every each time, wherein the sampling frequency can be between 100-2000 Hz, the resolution of the accelerometers is 16-bit or the above, and the noise of the accelerometers is 0.1-150 $\mu g/Hz^{1/2}$, but not limited thereto.

In an exemplary embodiment, a pre-treatment can be performed on the signal(s) by an Ensemble Empirical Mode Decomposition (EEMD) method for eliminating the noise influence, and each mode can be determined by using Hilbert-Huang transform method. In addition, Random Decrement Technique (RDT) can be used to obtain the free vibration modal response for structure, and Ibrahim Time Domain (ITD) method can be used for identification. In the other exemplary embodiment, for the normal monitoring, Stochastic Subspace Identification-covariance driven (SSI- COV) and Recursive Stochastic Subspace Identification-covariance driven (RSSI-DATA & RSSI-COV) can also be used for identification. And, the dynamic parameters (for example, the natural frequency, damping, vibration mode, etc.) of the structure can be extracted according to the output information obtained by measuring the small vibration. At the abnormal state, the damage can be estimated by the measured signal(s), and different damage levels can be established for defining or obtaining the time, location, degree about damage happening.

Figure 5:
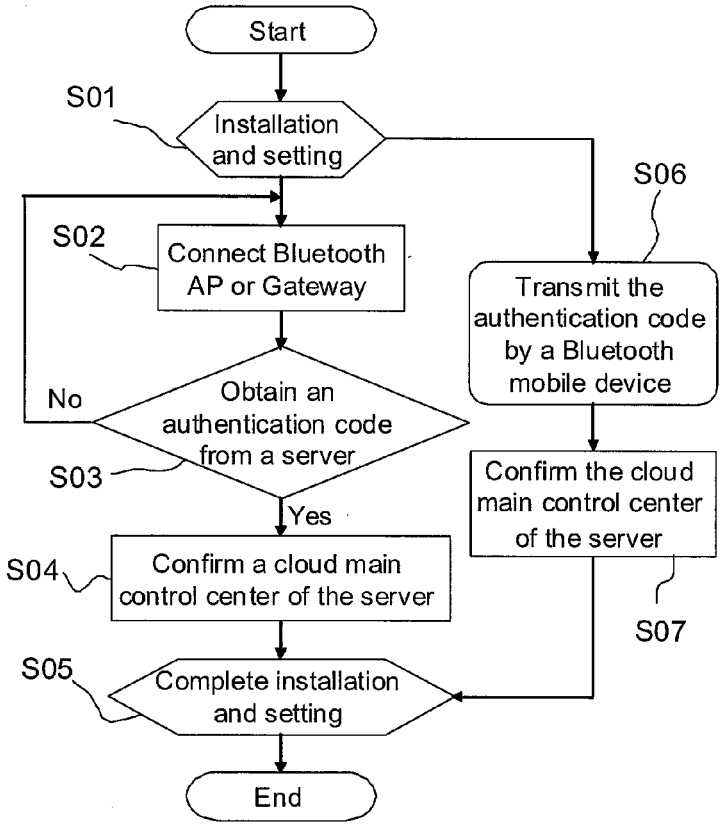
FIG. 5-FIG. 9 are flowcharts illustrating operation steps of a solar LED lamp wireless sensor device in different operation phases.

Embodiments of Operation Steps of the Structural Safety Monitoring and Lighting System Referring to FIG. 5, FIG. 5 is a flowchart illustrating operation steps of a solar LED lamp wireless sensor device in a setup phase. First, in a step S01, during a setup process, a step S02 or an alternative step S06 can be executed to implement the setup procedure according to an actual requirement. For example, the step S02 is executed, by which when a wireless communication interface of the solar LED lamp wireless sensor device is bluetooth, the solar LED lamp wireless sensor device can be connected to a near-end bluetooth access point (AP) to access the Internet, and when the wireless communication interface of the solar LED lamp wireless sensor device is Wi-Fi, the solar LED lamp wireless sensor device can be connected to a near-end gateway to access the Internet. In step S03, if an authentication code of the main control center cannot be downloaded through the network connection components, the flow returns to the step S02, and the step S02 is repeated until a step S04 is executed, by which after the solar LED lamp wireless sensor device obtains the authentication code from the main control center, the solar LED lamp wireless sensor device confirms the server of the main control center corresponding to the remote cloud. Then, in step S05, the setup procedure is completed. When the step S06 is executed after the step S01, the bluetooth wireless interface of a neighbouring mobile device of the solar LED lamp wireless sensor device is used for connection to directly transmit the authentication code to the solar LED lamp wireless sensor device. In step S07, the mobile device replaces the server to execute a confirmation operation until a confirmation procedure is completed. Then, the step S05 is executed to complete the setup procedure.

Figure 6:
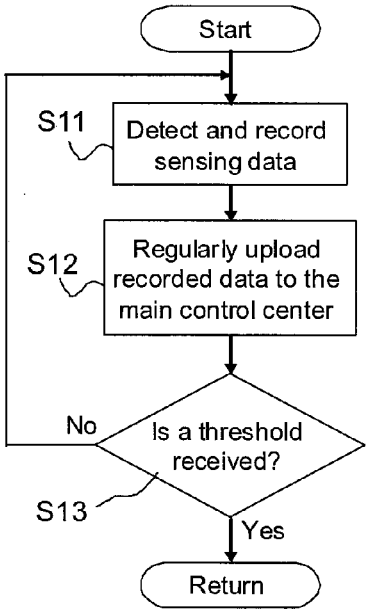

Referring to FIG. 6, FIG. 6 is a flowchart illustrating operation steps of a solar LED lamp wireless sensor device in a test phase. In step S11, solar LED lamp wireless sensor device continuously perform detection activities and records sensing data of the sensor. In step S12, the solar LED lamp wireless sensor device regularly uploads the records to the main control center through a wireless network connection, and the step is repeatedly executed until the solar LED lamp wireless sensor device receives threshold information transmitted back from the main control center. As shown in step S13, operations of the test phase are completed.

Figure 7:
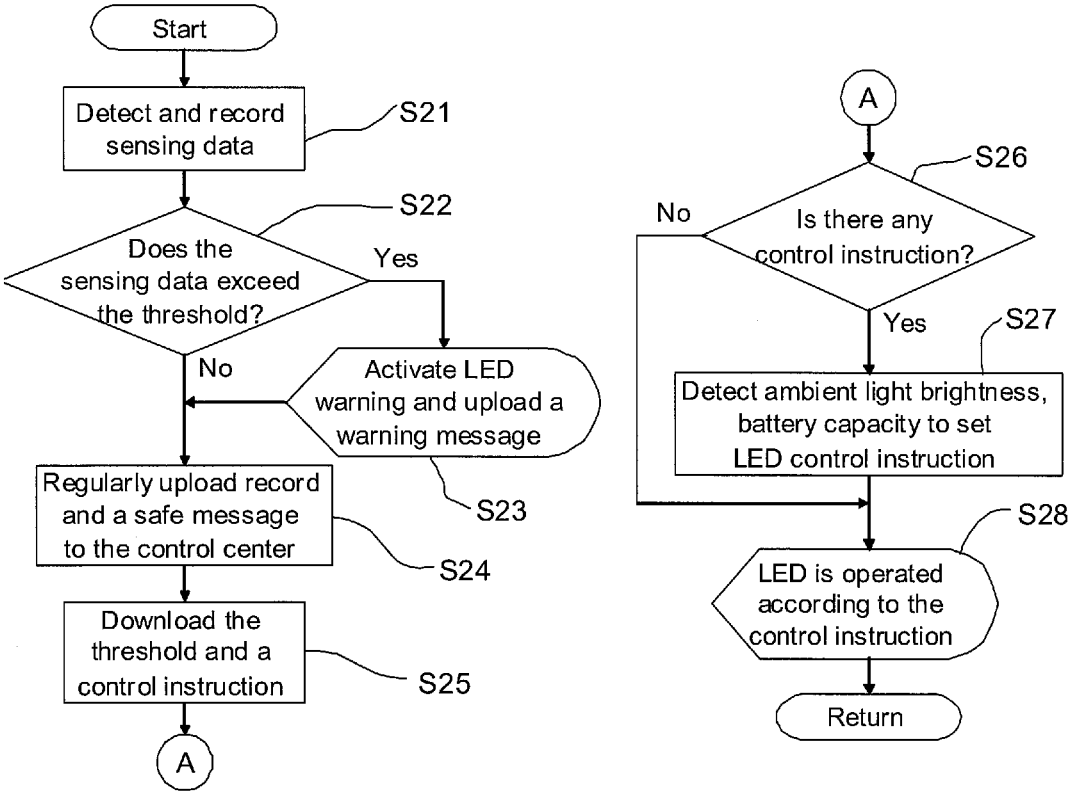

Referring to FIG. 7, FIG. 7 is a flowchart illustrating operation steps of a solar LED lamp wireless sensor device in a guard phase and an alert phase. When the solar LED lamp wireless sensor device receives the threshold information from the main control center, an operation stage of a guard phase is started. In step S21, the solar LED lamp wireless sensor device continuously performs detection activities and records sensing data of the sensor. In step S22, the solar LED lamp wireless sensor device compares the threshold with the sensing data, and when the sensing data exceeds the threshold, a step S23 is executed to enter the alert phase, by which an LED warning message is activated, and a warning message notification is uploaded to the main control center. When the sensing data does not exceed the threshold, a step S24 is executed, by which only the recorded sensing data is regularly uploaded, and a device safety message is transmitted. In step S25, when the main control center has new threshold information or a new control instruction, the new threshold information or the new control instruction is immediately transmitted to the solar LED lamp wireless sensor device. In step S26, the solar LED lamp wireless sensor device keeps detecting whether there is the new control instruction. In step S27, when the new control instruction is not detected, the solar LED lamp wireless sensor device learns an ambient light brightness according to an operation status of the solar cell, and sets an LED control instruction according to an amount of power stored in the battery and a duration of the night. Finally, in step S28, the LED control instruction is executed. The LED control instruction can be a control instruction sent by the main control center, or a control instruction defined by the solar LED lamp wireless sensor device itself. The LED control instruction can be executed to implement different brightness, different colours, different blinking cycles, bright and dark switch of different duty cycles. When a system is composed of a plurality of the solar LED lamp wireless sensor devices, a complicated pattern and image can be lighted according to different LED control instructions.

Figure 8:
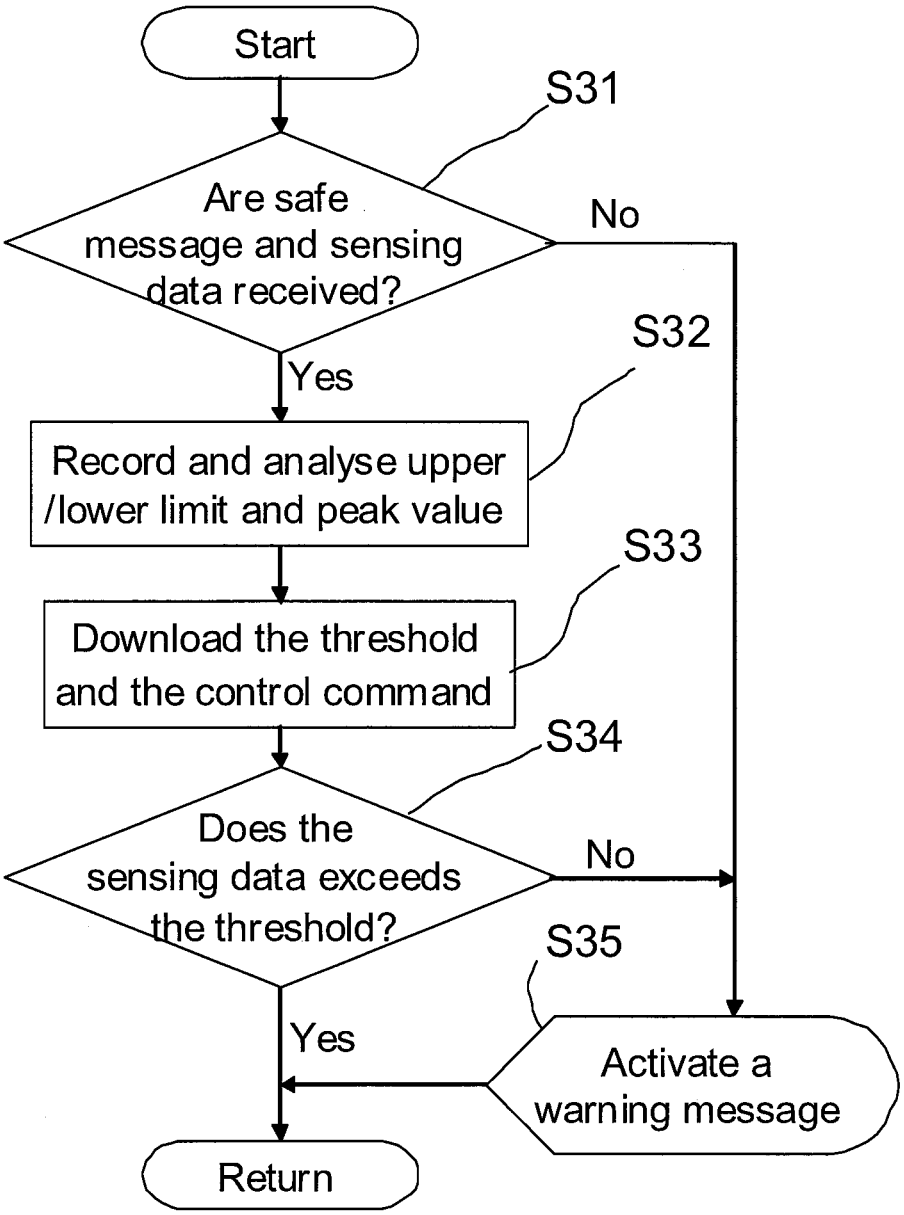

Referring to FIG. 8, FIG. 8 is a flowchart illustrating operation steps of the main control center of the structural safety monitoring and lighting system in a guard phase and an alert phase. After the server of the main control center respectively defines and transmits different thresholds to the corresponding solar LED lamp wireless sensor devices according to the sensing data transmitted by different solar LED lamp wireless sensor devices, the server and the corresponding solar LED lamp wireless sensor device simultaneously enter the guard phase. When the server of the main control center operates in the guard phase, in step S31, the server keeps monitoring whether safe messages and sensing data are regularly received, and if not, the server enters the alert phase, and a step S35 is executed. Otherwise, in step S32, the server records and analyses an upper/lower limit of data, a latent change, or whether there is a sudden change or a peak according to the received sensing data. In step S33, when it is necessary, the server modifies the transmitted thresholds and the control instructions and transmits the same to each of the solar LED lamp wireless sensor devices. In step S34, when the sensing data exceeds the threshold, the alert phase is entered, and the step S35 is executed. Conversely, the monitoring task of the guard phase is continuously executed. In the step S35, when there is a safety issue, and the alert phase is entered, the server of the main control center notifies the corresponding solar LED lamp wireless sensor device or the neighbouring solar LED lamp wireless sensor devices to simultaneously send warning messages of different degrees.

Figure 9:
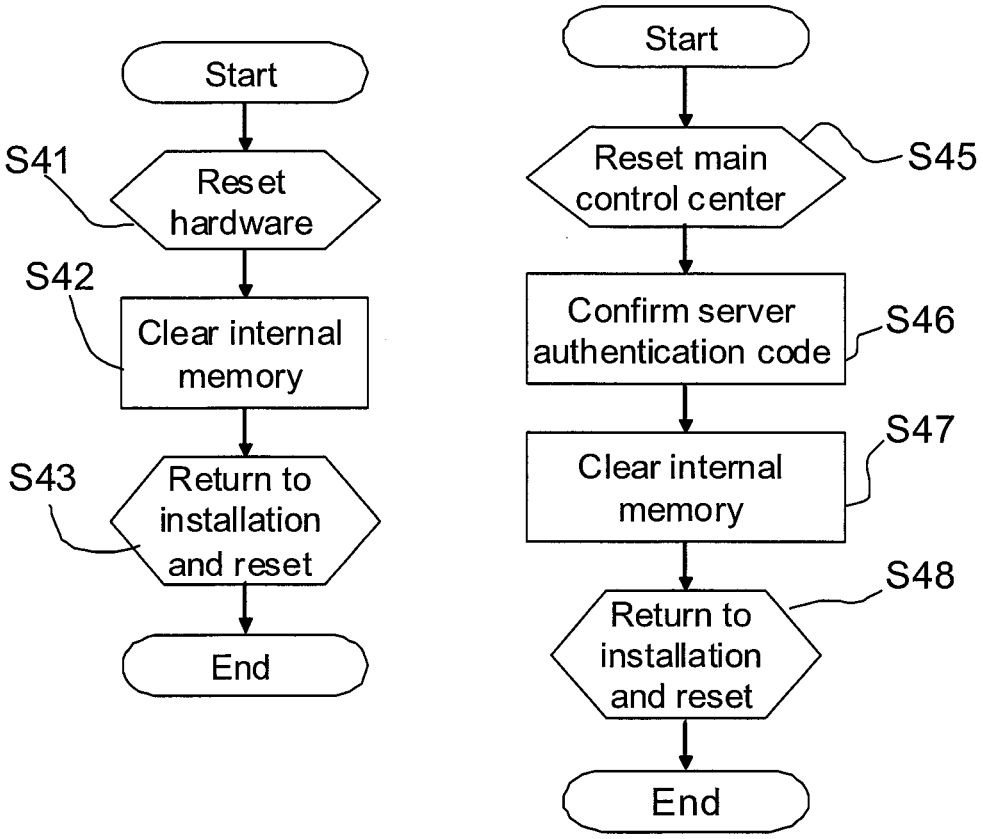

Referring to FIG. 9, FIG. 9 is a flowchart illustrating operation steps of a solar LED lamp wireless sensor device in a reset phase. When a certain solar LED lamp wireless sensor device has an installation variation, in step S41, the solar LED lamp wireless sensor device starts a hardware reset procedure. In step S42, the solar LED lamp wireless sensor device clears the authentication code stored in a memory, and clears the completion confirmation procedure and information set in the setup phase. In step S43, the solar LED lamp wireless sensor device returns to a mode that an initial installation is not completed, which is just like a newly manufactured product. The procedure of the reset phase can be executed according to an instruction sent by the main control center, as that shown in S45. In step S46, the main control center transmits the authentication code and a clear instruction. In step S47, the solar LED lamp wireless sensor device would clear the data in the memory according to the clear instruction. Finally, in step S48, the solar LED lamp wireless sensor device returns to the mode that the initial installation is not completed, which is just like a newly manufactured product.

Embodiment for Monitoring a Bridge Structure

Figure 10:
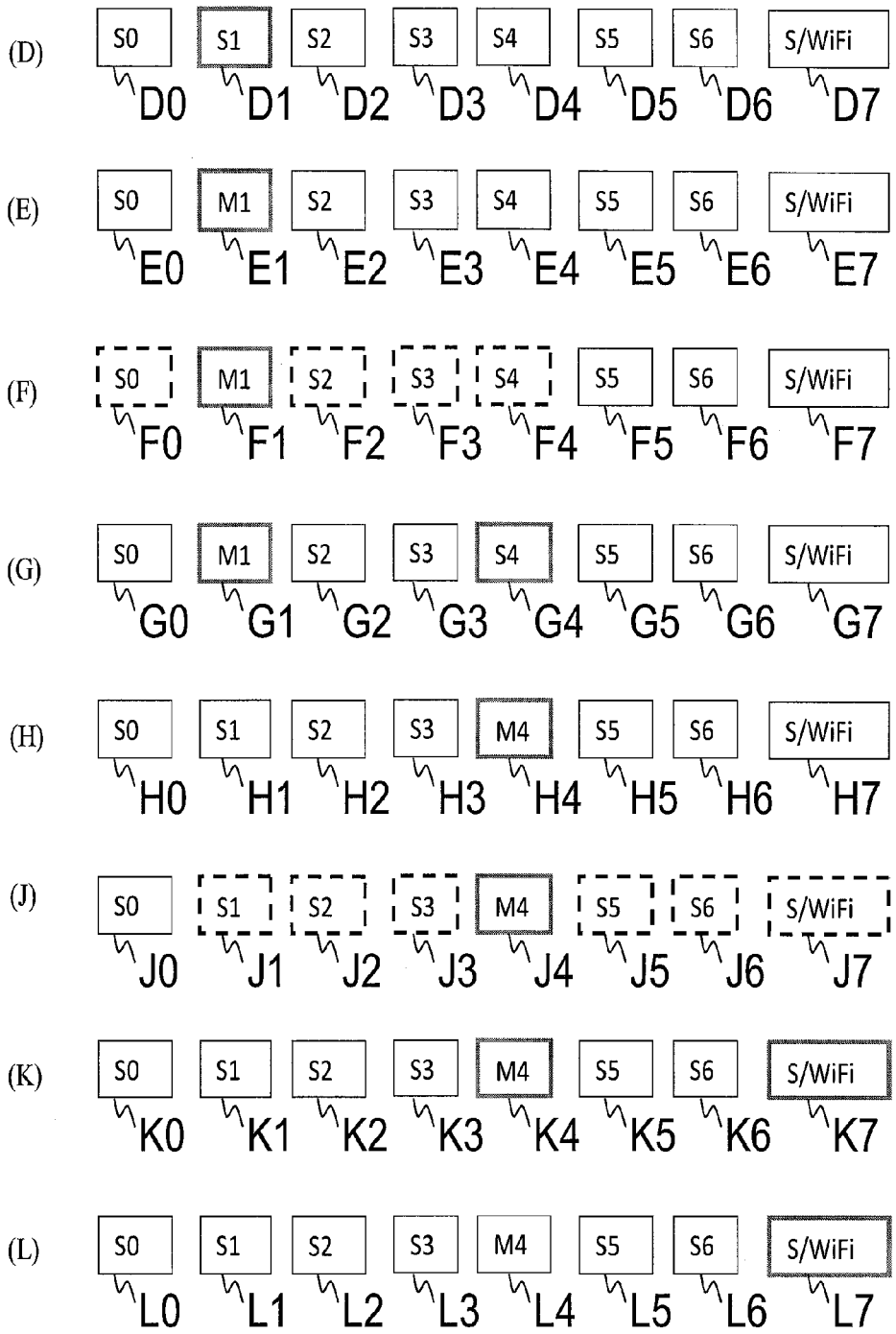
FIG. 10 is a schematic diagram of communication implementation of a structural safety monitoring and lighting system according to another embodiment of the invention.

Referring to 8 steps shown in FIGS. 10(D)-10(L), FIGS. 10(D)-10(L) are schematic diagrams of steps of transmitting data by switching a master/slave mode, in which a right half of the bridge is illustrated. Referential numbers D0-D6, E0-E6, G0-G6, H0-H6, J0-J6, K0-K6, and L0-L6 are solar LED lamp wireless sensor devices installed on the bridge, and positions thereof can be arbitrarily arranged, and are not limited to be arranged in a straight line. In FIG. 10, positions of the solar LED lamp wireless sensor devices are illustrated in a straight line only in order to clearly disclose the steps. Referential numbers D7, E7, F7, G7, H7, J7, K7 and L7 are wireless communication relay stations capable of connecting the Internet, and are installed at two ends of the bridge. Referring to FIG. 10(D) and FIG. 1, the control unit 11 of FIG. 1 stores coordinate data of longitude and latitude and altitude of the solar LED lamp wireless sensor devices installed to the bridge. When the wireless communication module 11' serves as a slave node, the data broadcasted by the wireless communication module 11' includes a referential number (ID) of the monitoring device itself, and coordinates of longitude and latitude and altitude of the place where the monitoring device is located. When deployment of the solar LED lamp wireless sensor devices is complete, each of the solar LED lamp wireless sensor devices simultaneously stores coordinates of a plurality of relay stations disposed at the two ends of the bridge or at places capable of transmitting data, for example, D7 in FIG. 10(D) is a right end relay station. The referential number (ID) of the monitoring device can be a general name, a MAC address or an IP address. Regarding the bridge monitoring, operation mechanisms and methods of the related components of the solar LED lamp wireless sensor devices monitoring the bridge function are as follows.

Step one, solar LED lamp wireless sensor slave node(s): as shown in FIG. 10(D). Each of the solar LED lamp wireless sensor devices D0-D6 is generally a Bluetooth slave node, and regularly reads sensing values of the three-axis accelerometer thereof for determination. A determination method is to determine whether there is a safety issue according to an inbuilt formula and historical data, where the inbuilt formula or a look-up table can be obtained according to design values of the bridge or by simulating the whole bridge to evaluate a safety data range of each node that is influenced by winds, earthquakes or large vehicles, etc. If a sensing value of the three-axis accelerometer read by a certain solar LED lamp wireless sensor device exceeds a safety range threshold, for example, the S1 solar LED lamp wireless sensor device D1 of FIG. 10 (D), a step two is executed.

Step two, solar LED lamp wireless sensor master node(s): as shown in FIG. 10(E). The M1 solar LED lamp wireless sensor device E1 is immediately changed from the slave node S1 to a bluetooth master node M1, and scans the neighbouring S0-S6 slave nodes E0-E6.

Step three, as shown in FIG. 10(F), due to factors of a wireless communication distance, interference, etc., when the M1 bluetooth master node F1 obtains referential numbers (ID) and coordinates of longitude, latitude and altitude of the neighbouring S0 slave node F0, S2 slave node F2, S3 slave node F3 and S4 slave node F4, distances between these slave nodes and the recorded relay stations (including S/WiFi relay station F7, as shown in FIG. 10(G)) are calculated, and it is determined that the distance between the S/WiFi relay station G7 and the S4 slave node G4 is the shortest.

Step four, as shown in FIG. 10(G), after the M1 bluetooth master node F1 determines that the distance between the S/WiFi relay station G7 and the S4 slave node G4 is the shortest, the M1 bluetooth master node F1 starts to connect the S4 slave node G4, and writes the abnormal sensing data thereto.

Step five, as shown in FIG. 10(H), the S4 slave node G4 written by the M1 bluetooth master node G1 is immediately changed to M4 bluetooth master node H4.

Step six, as shown in FIG. 10(J), the M4 bluetooth master node J4 repeats the step two and the step three until the S/WiFi relay station J7 can be directly connected, and the abnormal sensing data can be transmitted to the S/WiFi relay station J7, as shown in FIG. 10(K).

Step seven, as shown in FIG. 10(L), after the S/WiFi relay station L7 receives the abnormal sensing data, the S/WiFi relay station L7 transmits the same to the master control center to achieve the purpose of master-slave switching of each of the solar LED lamp wireless sensor devices to transmit data. If the S/WiFi relay station L7 is damaged, when the task is unable to be completed, the transmitted data includes a relay station damage message. During the master-slave switching process of each solar LED lamp wireless sensor device, when the relay station damage message is found, the information of the relay station is modified to search other shortest transmission path to continually complete the data transmission task. During the master-slave switching process of each solar LED lamp wireless sensor device, when a message of a newly added relay station is found, the information of the relay station is modified, and in further master-slave switching activities, the message containing information of the new relay station is transmitted.

If more than one solar LED lamp wireless sensor devices discover abnormal conditions, the safety monitoring slave nodes can be directly changed to master nodes in succession, and scan the other neighbouring nodes, and the slave nodes written with data send messages including its own information and the abnormal sensing data in succession. Once the master node writes data into the selected slave node, the master node itself is immediately changed to a slave node, and stays to serve as the slave node by, for example, 60 seconds, so as to obtain a larger data transmission amount without occupying much permission of the master node. In this way, the worst case is that each node on the bridge has data to transmit, and it is assumed that a data transmission distance of each node is 50 meters, and a distance between two neighbouring nodes is 1 meter, so that the first to the fiftieth slave nodes that are closest to the relay station can all successfully transmit data to the relay station. Obviously, the farther a data transmission distance of each node is, the shorter time is required for transmitting the abnormal sensing data to the relay station, and the more denser the nodes is, the more possible a local damage situation is detected. In the present embodiment, each safety monitoring device is spaced from the neighbouring safety monitoring device by one meter, and when a safety issue occurs, a controller can easily focus on the problem, and deals with the problem in the most expeditious manner, so as to avoid occurrence of the safety problem.

Embodiment of Auto Repair of the Safety Monitoring System

If a relay station is damaged, the data can be transmitted to the undamaged relay station to automatically repair the communication system, so as to greatly improve reliability of the system.

In a method for determining whether the relay station is damaged, if the last node cannot transmit data to the relay station and the transmission cannot be implemented after three continuous attempts, it is determined that the relay station is malfunctioned. In the last, after the message is transmitted to another relay station without malfunction, the message can be transmitted to the main control center to implement maintenance and repair.

According to the data transmission method of the invention, a situation that the damaged slave node can still transmit data to the relay station is avoided, since when the abnormal node scans the valid slave nodes, according to the aforementioned embodiment, it is known that there are probably 50 slave nodes available for selection, so that the data can be indeed transmitted to the relay station. Moreover, the main control center analyses the received data, and if a certain slave node is abnormal, the neighbouring nodes should send abnormal messages of different degrees, and if there is not such activity, the neighbouring nodes probably have a problem.

In case of no safety issue, each of the solar LED lamp wireless sensor devices regularly performs self test operations/steps, which are as follow.

Step one, regular operation: each node regularly transmits a safety message to the relay station every 24 hours, and if a node is malfunctioned, the uploaded data of the relay station may have related message, so as to facilitate maintenance and repair. Regarding a damaged node, replacement thereof is only mechanical disassembling, and only coordinate data of longitude, latitude and altitude of the relay station, coordinate data of longitude, latitude and altitude of itself and a related operation program are provided for resetting the node.

Step two, calibration operation: a timer of each node is required to be calibrated, and regarding the bridge monitoring, requirement on synchronization of the timers of the nodes is more stringent, and a method thereof is that the relay station obtains a standard time from the cloud every a fixed time interval, and write the current standard time to the neighbouring slave nodes, and the slave nodes written with the standard time are changed to the master nodes to write the current standard time to the neighbouring slave nodes until the timers of all of the nodes are updated to the current standard time, so as to achieve a synchronization activity.

Possible Effects of Embodiments

Embodiment One: Single Tower Cable-stayed Bridge

A single tower cable-stayed bridge is constructed in a curved shape of streamline in collaboration with an image and concept of a sailing ship, a bridge span is about 164 meters, an average width of the bridge is 5 meters, a height of a bridge tower is 49 meters, a distance between a water (liquid) level in the harbour and the bottom of the bridge is about 12 meters.

The solar LED lamp wireless sensor devices respectively containing the three-axis accelerometer and an exposed liquid level ultrasonic sensor are disposed every other meter at both sides of the bridge and the bridge tower, and totally 426 solar LED lamp wireless sensor devices are installed. Fourth colors RGBW of the lamp of the device may achieve a multi color dimming function, which is not only used for lighting and decoration lighting, but is also used for monitoring a level change of river, a bridge tower vibration and a bridge deck vibration, and vibration peaks, off peaks of the past are recorded in a long-term, which becomes a main prevention mechanism of safety monitoring.

Embodiment Two: Monitoring of a Train Bridge

Regarding monitoring of the train bridge, a plurality of the solar LED lamp wireless sensor devices containing the three-axis accelerometer are installed on the bridge, and when a train passes by, 40 seconds of vibration is recorded, a frequency spectrum recorded by the accelerometer is 0.25-20 Hz, and a recording time of each sensor device is required to be synchronized.

Railway safety monitoring is another application of the invention, when the train is running at a high speed, deformation of railway may cause a disaster, so that deflection meters and thermometers are installed on the railway to detect whether the railway is displaced or sunk due to external force, or whether the railway is deformed due to a temperature variation. Moreover, the deflection meters and hydraulic gages are installed on railway embankment to detect whether the railway embankment is displaced or sunk.

Embodiment Three: Monitoring of Electric Tower, Monitoring of Electric Tower Landslide Electric towers are distributed in remote mountainous areas in large numbers, and face blowing of strong winds over a long period of time, and the mountainous areas have a risk of earthquakes or landslides, so that an electric tower safety monitoring system is necessary. According to the invention, a plug and play wireless communication network is used, and by installing the solar LED lamp wireless sensor devices respectively containing an inclinometer at 8 positions on each of an upper layer and a lower layer of the electric tower (total 16 sensing points), a three-dimensional tilt status of the electric tower can be monitored in real-time 24-hour a day, and data is transmitted to the main control center through the wireless communication network in real-time, such that a supervisor can learn a tilt status of the electric tower without checking the electric tower onsite.

In summary, the invention provides a safety monitoring apparatus and system for bridge, building or structure, which has features of simple installation and setting, and can be used in long-time, and is neither in need of direct control of manpower, nor in need of power supply of a city power. The apparatus and system of the invention can be applied in wild, remote area, or long bridges, viaducts, urban rapid transit rails, railway tracks contacting towns, or even electric towers, mountain slopes, flood banks of river or sea, etc. to achieve a safety monitoring effect.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A solar light-emitting diode (LED) lamp wireless sensor device for monitoring structure safety in real-time, having characteristics of simple installation and setting, suitable for being used in long-term, and being neither in need of direct control of manpower, nor in need of power supply of a city power, comprising:

a substrate;

at least one LED lamp bead and a driving circuit thereof, disposed on the substrate;

at least one type of monitoring sensor, disposed on the substrate;

a wireless communication module, disposed on the substrate, transmitting messages and exchanging operation instructions to external;

a solar cell, electrically connected to the substrate, and electrically connected to a rechargeable battery through a charging/discharging circuit, and charging the rechargeable battery and supplying a device operation power;

a control unit, electrically connected to the LED lamp bead, the driving circuit, the monitoring sensor, the wireless communication module and the rechargeable battery, and controlling a whole device operation, wherein the control unit in a default mode is written with an authentication code by another wireless device through radio connection, and a device having the same authentication code is written with wireless connection hops used for connecting the Internet with one increased code, so as to connect the Internet through a wireless communication continuation manner; and when the Internet is disconnected, the control unit automatically searches the neighboring solar LED lamp wireless sensor devices having the same authentication code and having smaller wireless connection hops to connect the Internet, and gradually searches the other solar LED lamp wireless sensor devices having larger wireless connection hops, so as to achieve an automatic connection recovery mechanism after the Internet is disconnected; and the control unit automatically sends a warning signal in case of a safety issue, and notifies the neighboring solar LED lamp wireless sensor devices having similar wireless connection hops to simultaneously activate a warning mechanism; and a casing, containing the substrate, the other components on the substrate and the rechargeable battery electrically connected to the substrate to form a waterproof sealed container, wherein the casing is capable of being directly fixed to a monitored structure through mechanical fixing members, and at least a part of the casing is transparent, and is pervious to light.

2. The solar LED lamp wireless sensor device as claimed in claim 1, wherein during a normal operation, the solar cell irradiated by sunlight generates an operation power, and stores excess energy for using in case of no sunlight, the control unit reads sensing data output by the monitoring sensor, and compares the sensing data with recorded data to determine whether the sensing data exceeds a threshold, so as to determine whether a safety issue occurs; the control unit exchanges the sensing data and the threshold with a main control center through the wireless communication module via the Internet, and opportunely receives a control instruction from the main control center, and when the safety issue occurs or data update is performed according to the control instruction of the main control center, the LED lamp beads are driven to react in real-time;

when there is no safety issue, and the environment has a lighting need, and the rechargeable battery has sufficient stored power, the rechargeable battery is capable of supplying power for system operation and supplying power to the LED lamp beads for lighting or decoration lighting of the structure, and the wireless communication module is used for transmitting control data for controlling flashing paces, brightness or colors of the LED lamp beads.

3. The solar LED lamp wireless sensor device as claimed in claim 2, wherein when a system is a safety monitoring network composed of a plurality of the solar LED lamp wireless sensor devices, each of the solar LED lamp wireless sensor devices is switched between master-slave identities, in case that the master-slave identities are switched in alternation, data transmission is continued, such that a data transmission range exceeds a transceiving range of a single wireless communication module.

4. The solar LED lamp wireless sensor device as claimed in claim 2, wherein when different types and numbers of the monitoring sensors are used, the sensing data of the monitoring sensor is any one of a temperature, a humidity, a wind speed, a water/liquid level, a tilt angle, a vibration cycle and a vibration amplitude, or a combination thereof.

5. The solar LED lamp wireless sensor device as claimed in claim 2, wherein an operation mechanism of safety monitoring comprises:

(a) a setup phase, corresponding to initial installation and setting of the solar LED lamp wireless sensor device, wherein after connecting the Internet, the wireless communication module obtains an authentication code from a server, and completes a confirmation procedure with the server of the main control center, or a mobile device directly transmits the authentication code, and sets to a mode of completing the confirmation procedure with the server of the main control center;

(b) a test phase: during which the solar LED lamp wireless sensor device is installed and enters a test mode, the control unit reads the sensing data from the monitoring sensor, and records and transmits the sensing data to the server of the main control center, and the server records all of the sensing data in the test phase, and accordingly analyses the threshold of the solar LED lamp wireless sensor device;

(C) a guard phase: during which the solar LED lamp wireless sensor device is installed, and receives the threshold from the server of the main control center, and the solar LED lamp wireless sensor device enters a service execution mode; when there is no control instruction, the control unit sets and executes an LED control instruction by itself, and when the control instruction is received from the main control center, the control unit executes operation control according to the control instruction, and the control unit compares the sensing data of the monitoring sensor with the recorded threshold, and when the sensing data exceeds the threshold, the safety issue occurs, an LED warning mechanism is activated, and a warning message is uploaded to the main control center;

(d) an alert phase: during which the solar LED lamp wireless sensor device detects the safety issue, or the main control center does not regularly receive the sensing data of the solar LED lamp wireless sensor device, or the received sensing data exceeds the threshold, the safety issue occurs; the main control center sends an instruction to the solar LED lamp wireless sensor device and the other neighboring solar LED lamp wireless sensor devices to notify the safety issue, and respectively transmits instructions to control the LED lamp beads to display warning messages of different degrees; the alert phase is returned to the guard phase through manual control performed at the main control center, or the alert phase is returned to the guard phase by manually relaxing and modifying the threshold; and (e) a reset phase: during which when the solar LED lamp wireless sensor device has an installation variation, the authentication code in a memory is directly cleared, and the completion confirmation procedure and information set in the setup phase are cleared to return to the default mode that an initial installation and setting are not completed.

6. The solar LED lamp wireless sensor device as claimed in claim 2, wherein the LED lamp bead is a combination of LED lamp beads of different colors, when the sensing data is within a safe range, the LED lamp beads with a first color indicating no safety issue are lighted, or light flashing signals of different cycles and frequencies are used to indicate the situation of no safety issue; conversely, when any sensing data exceeds the threshold, and the safety issue occurs, the LED lamp beads with a second color are lighted, so that through an intuitive manner, it is known that a relative position of the structure has a specific safety issue, or light flashing signals of different cycles and frequencies are used to indicate different dangerous situations of levels.

7. The solar LED lamp wireless sensor device as claimed in claim 1, wherein the wireless communication module is Bluetooth (BLE) or a combination of Bluetooth (BLE) and Wi-Fi.

8. A solar light-emitting diode (LED) lamp wireless sensor device for monitoring structure safety in real-time, comprising:

a substrate;

at least one LED lamp bead and a driving circuit thereof, disposed on the substrate;

at least one type of monitoring sensor, disposed on the substrate;

a wireless communication module, disposed on the substrate, transmitting messages and exchanging operation instructions to external;

a solar cell, electrically connected to the substrate, and electrically connected to a rechargeable battery through a charging/discharging circuit, and charging the rechargeable battery and supplying a device operation power;

a control unit, electrically connected to the LED lamp bead, the driving circuit, the monitoring sensor, the wireless communication module and the rechargeable battery, and controlling a whole device operation, wherein the control unit stores coordinate data of longitude, latitude and altitude of a place where the solar LED lamp wireless sensor device is installed; and a casing, containing the substrate, the other components on the substrate and the rechargeable battery electrically connected to the substrate to form a waterproof sealed container, wherein the casing is capable of being directly fixed to a monitored structure through mechanical fixing members, and at least a part of the casing is transparent, and is pervious to light, wherein a plurality of the solar LED lamp wireless sensor devices are fixed to a structure for safety monitoring, wherein at least one of the solar LED lamp wireless sensor devices is disposed at a relay station near a structure base, and the wireless communication modules of the solar LED lamp wireless sensor devices serve as slave nodes, and data broadcasted by the solar LED lamp wireless sensor device comprises a referential number, coordinates of longitude, latitude and altitude of a place where the solar LED lamp wireless sensor device is located, and each node also stores coordinates of the relay station disposed near the structure base, wherein the control unit further scans for the surrounding slave nodes or the relay station in case of a safety issue, and obtains referential numbers, coordinates of longitude, latitude and altitude of a plurality of neighboring slave nodes or related information of the relay station through scanning, and selects the slave node capable of communicating with the relay station according to distances between the slave nodes and the relay station, or directly connects the relay station.

9. The solar LED lamp wireless sensor device as claimed in claim 8, wherein the monitoring sensor is selected from an accelerometer, a temperature sensor, a wind speed sensor, a humidity sensor, an illuminance sensor, a gyroscope, and an altimeter.

10. The solar LED lamp wireless sensor device as claimed in claim 8, wherein a monitoring manner comprises:

S1. each of the solar LED lamp wireless sensor devices is generally a Bluetooth slave node, and regularly reads sensing values of the monitoring sensor built therein for determination, and a determination manner is to determine whether there is the safety issue according to an inbuilt formula and historical data, wherein the inbuilt formula or a look-up table is obtained by simulating a whole bridge to evaluate a safety data range of each node that is influenced by winds, earthquakes or vehicles passing there through, and each of the solar LED lamp wireless sensor devices is regularly changed from the slave node to a master node to transmit a safety message;

S2. when a certain solar LED lamp wireless sensor device receives a message transmitted by other solar LED lamp wireless sensor device or the read sensing value exceeds a safety threshold, the solar LED lamp wireless sensor device is immediately changed to a Bluetooth master node, and scans the surrounding slave nodes or the relay station, the solar LED lamp wireless sensor device obtains the referential numbers, coordinates of longitude, latitude and altitude of the plurality of neighboring slave nodes or related information of the relay station through scanning, and selects the slave node capable of communicating with the relay station according to distances between the slave nodes and the relay station, or directly connects the relay station;

S3. the solar LED lamp wireless sensor device connects the selected slave node or the relay station, and writes an abnormal sensing data and other communication message; and S4. the slave node written with data is immediately changed to the Bluetooth master node, and the S1-S4 are repeated until the abnormal sensing data is transmitted to the relay station, or the relay station written with data transmits the abnormal sensing data to a main control center.

* * * * *